US009834293B2

(12) United States Patent
Wood et al.

(10) Patent No.: US 9,834,293 B2
(45) Date of Patent: Dec. 5, 2017

(54) STEERING ASSEMBLY FOR DOCKING A MARINE VESSEL HAVING AT LEAST THREE PROPULSION UNITS

(71) Applicant: Marine Canada Acquisition Inc., Richmond (CA)

(72) Inventors: Neal Wood, Coquitlam (CA); Ray Wong, Richmond (CA)

(73) Assignee: Marine Canada Acquisition Inc., Richmond (CA)

( * ) Notice: Subject to any disclaimer, the term of this patent is extended or adjusted under 35 U.S.C. 154(b) by 0 days.

(21) Appl. No.: 15/021,466

(22) PCT Filed: Sep. 15, 2014

(86) PCT No.: PCT/CA2014/050879
§ 371 (c)(1),
(2) Date: Mar. 11, 2016

(87) PCT Pub. No.: WO2015/035522
PCT Pub. Date: Mar. 19, 2015

(65) Prior Publication Data

US 2016/0221659 A1 Aug. 4, 2016

Related U.S. Application Data

(60) Provisional application No. 61/877,907, filed on Sep. 13, 2013.

(51) Int. Cl.
*B63H 21/21* (2006.01)
*B63H 25/42* (2006.01)

(52) U.S. Cl.
CPC ..... *B63H 21/213* (2013.01); *B63H 25/42* (2013.01)

(58) Field of Classification Search
CPC ..... B63H 21/213; B63H 21/42
(Continued)

(56) References Cited

U.S. PATENT DOCUMENTS 7,056,169 B1 * 6/2006 Lokken ..... B63H 21/265 440/63
7,467,595 B1 * 12/2008 Lanyi ..... B63H 21/213 114/144 R (Continued)

FOREIGN PATENT DOCUMENTS

| | | |
|---|---|---|
| WO | 2007105995 | 9/2007 |
| WO | 2013122516 | 8/2013 |
| WO | 2013122516 A1 | 8/2013 |

OTHER PUBLICATIONS

WIPO, International Searching Authority, International Search Report dated Nov. 17, 2014 in International Patent Application No. PCT/CA2014/050879, 3 pages.

(Continued)

*Primary Examiner* — Lars A Olson
*Assistant Examiner* — Jovon Hayes
(74) *Attorney, Agent, or Firm* — Cameron IP

(57) ABSTRACT

A steering system for a marine vessel comprises a first propulsion unit, a second propulsion unit, and a third propulsion unit. There is a hydraulic actuator for imparting steering motion to the first propulsion unit and a hydraulic actuator for imparting steering motion to the second propulsion unit. A tie bar couples a tiller of the third propulsion unit to the hydraulic actuator of the first propulsion unit. A joystick is used to input user steering commands to the steering system. Movement of the joystick actuates the said hydraulic actuators to impart steering motion to the first propulsion unit and the second propulsion unit. The third (Continued)

propulsion unit is put in neutral when the joystick is used to input user steering commands.

12 Claims, 5 Drawing Sheets

(58) Field of Classification Search
USPC ..... 440/61 S
See application file for complete search history.

(56) References Cited

U.S. PATENT DOCUMENTS 7,993,175 B2 * 8/2011 Hiroshima ..... B63H 20/00 440/84
8,141,510 B2 * 3/2012 Ito ..... B63H 25/36 114/144 RE
8,170,733 B2 * 5/2012 Blum ..... B63H 21/21 440/84
8,682,515 B2 * 3/2014 Ito ..... B63H 21/213 440/84
8,777,681 B1 * 7/2014 McNalley ..... B63H 25/42 440/53
9,481,435 B1 * 11/2016 Jaszewski ..... B63H 20/06
2004/0005824 A1 * 1/2004 Zeiger ..... B63H 20/12 440/63
2005/0042951 A1 * 2/2005 Morvillo ..... B63H 11/11 440/100
2007/0093147 A1 * 4/2007 Mizutani ..... B63H 20/00 440/1
2010/0305789 A1 * 12/2010 Ito ..... B63H 21/213 701/21
2012/0244761 A1 * 9/2012 Davidson ..... B63H 20/12 440/61 S
2014/0364019 A1 * 12/2014 Ito ..... B63H 20/12 440/1
2015/0127197 A1 * 5/2015 Lindeborg ..... B63H 25/02 701/21
2016/0221659 A1 * 8/2016 Wood ..... B63H 25/42

OTHER PUBLICATIONS

WIPO, International Searching Authority, Written Opinion dated Nov. 17, 2014 in International Patent Application No. PCT/CA2014/050879, 3 pages.
Extended European search report for European Patent Application No. 14844342.7 dated Mar. 17, 2017.

* cited by examiner

| ENGINE | GEAR | TRIM |
|---|---|---|
| STARBOARD ENGINE | FORWARD | DOWN |
| CENTER ENGINE | NEUTRAL | UP |
| PORT ENGINE | REVERSE | DOWN |

FIG. 4

| ENGINE | POWER | TILT |
|---|---|---|
| STARBOARD ENGINE | ON | IN WATER |
| CENTER ENGINE | OFF | OUT OF WATER |
| PORT ENGINE | ON | IN WATER |

FIG. 5

STEERING ASSEMBLY FOR DOCKING A MARINE VESSEL HAVING AT LEAST THREE PROPULSION UNITS

BACKGROUND OF THE INVENTION

Field of the Invention

The present invention relates to a steering assembly for docking a marine vessel and, in particular, to a steering assembly for docking a marine vessel with at least three propulsion units.

Description of the Related Art

In conventional marine steering systems, an operator may use a joystick to manoeuver and dock the marine vessel. The joystick allows the operator to manoeuver the marine vessel in a lateral direction, i.e. in a direction which is substantially perpendicular to a longitudinal axis of the marine vessel. This lateral directional movement is achieved by independently steering the propulsion units of the marine vessel to effect vector thrusting. For example, in a marine vessel provided with two propulsion units, shifting one of the propulsion units into reverse and simultaneously shifting the other propulsion unit into forward while selectively adjusting the steering angles of the propulsion units can cause the marine vessel to move in a lateral direction. The joystick controls both steering functions and shift and control functions during docking. Such conventional steering systems are also typically provided with a helm for steering the marine vessel on open water and a control lever for controlling shift and throttle functions on open water. An example of a conventional steering system is disclosed in PCT International Application Publication Number WO 2013/123208 A1.

SUMMARY OF THE INVENTION

It is an object of the present invention to provide an improved steering system assembly for a marine vessel which has at least three propulsion units.

There is accordingly provided a steering system for a marine vessel having a first propulsion unit, a second propulsion unit, and a third propulsion unit. There is a hydraulic actuator for imparting steering motion to the first propulsion unit and a hydraulic actuator for imparting steering motion to the second propulsion unit. A tie bar couples a tiller of the third propulsion unit to the hydraulic actuator of the first propulsion unit. The tie bar imparts steering motion from the hydraulic actuator of the first propulsion unit to the tiller of the third propulsion unit. A joystick is used to input user steering commands to the steering system. Movement of the joystick actuates the said hydraulic actuators to impart steering motion to the first propulsion unit and the second propulsion unit. The third propulsion unit may be put in neutral when the joystick is used to input user steering commands. The third propulsion unit may also be trimmed up when the joystick is used to input user steering commands. Alternatively, the third propulsion unit may be turned off when the joystick is used to input user steering commands.

BRIEF DESCRIPTIONS OF DRAWINGS

The invention will be more readily understood from the following description of the embodiments thereof given, by way of example only, with reference to the accompanying drawings, in which:

FIG. 4 is a table showing operating states of the propulsion units of the steering system of FIG. 1; and FIG. 5 is another table showing operating states of the propulsion units of the steering system of FIG. 1.

DESCRIPTIONS OF THE PREFERRED EMBODIMENTS

Figure 1:
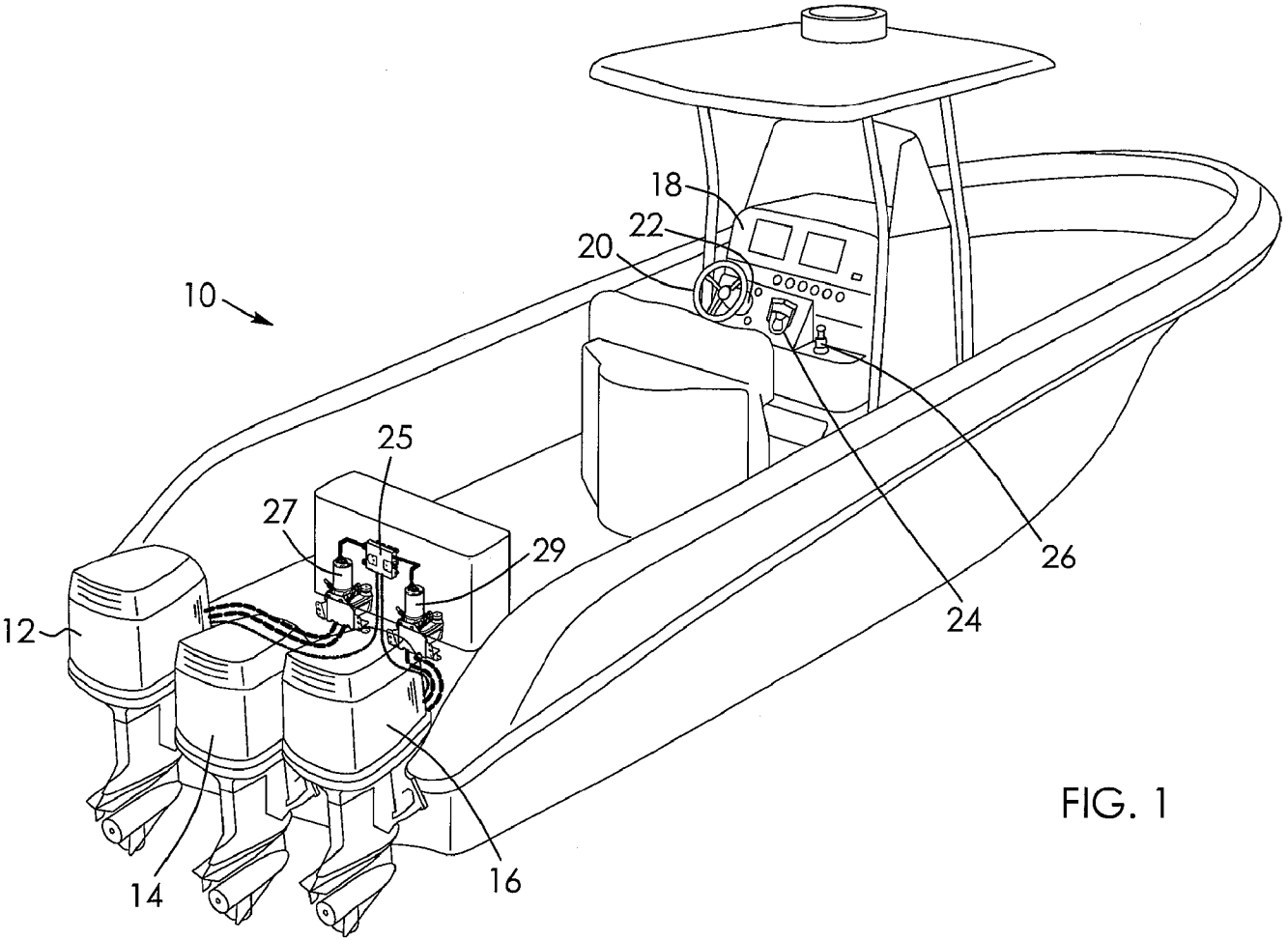
FIG. 1 is a perspective view of a marine vessel provided with a plurality of propulsion units and an improved steering system.

Referring to the drawings and first to FIG. 1, this shows a marine vessel 10 which is provided with a plurality of propulsion units in the form of three outboard engines, namely, a port engine 12, a center engine 14, and a starboard engine 16. The marine vessel 10 is also provided with a control station 18 that supports a steering wheel 20 mounted on a helm 22, a control head 24, and a joystick 26. The control station 18 is conventional and allows the port engine 12 and the starboard engine 16 to be steered using either the steering wheel 20 and the helm 22 or the joystick 26 as disclosed in PCT International Application Publication Number WO 2013/123208 A1 which is incorporated herein by reference.

Figure 2:
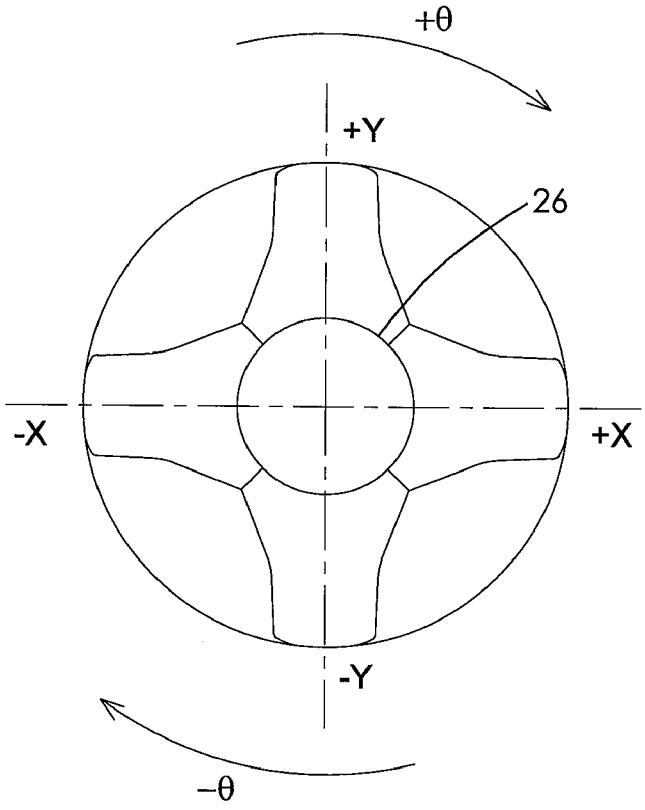
FIG. 2 is a simplified top plan view of a joystick of the steering system of FIG. 1 showing a guided plate inside the joystick and axes of movement of the joystick.
Figure 3:
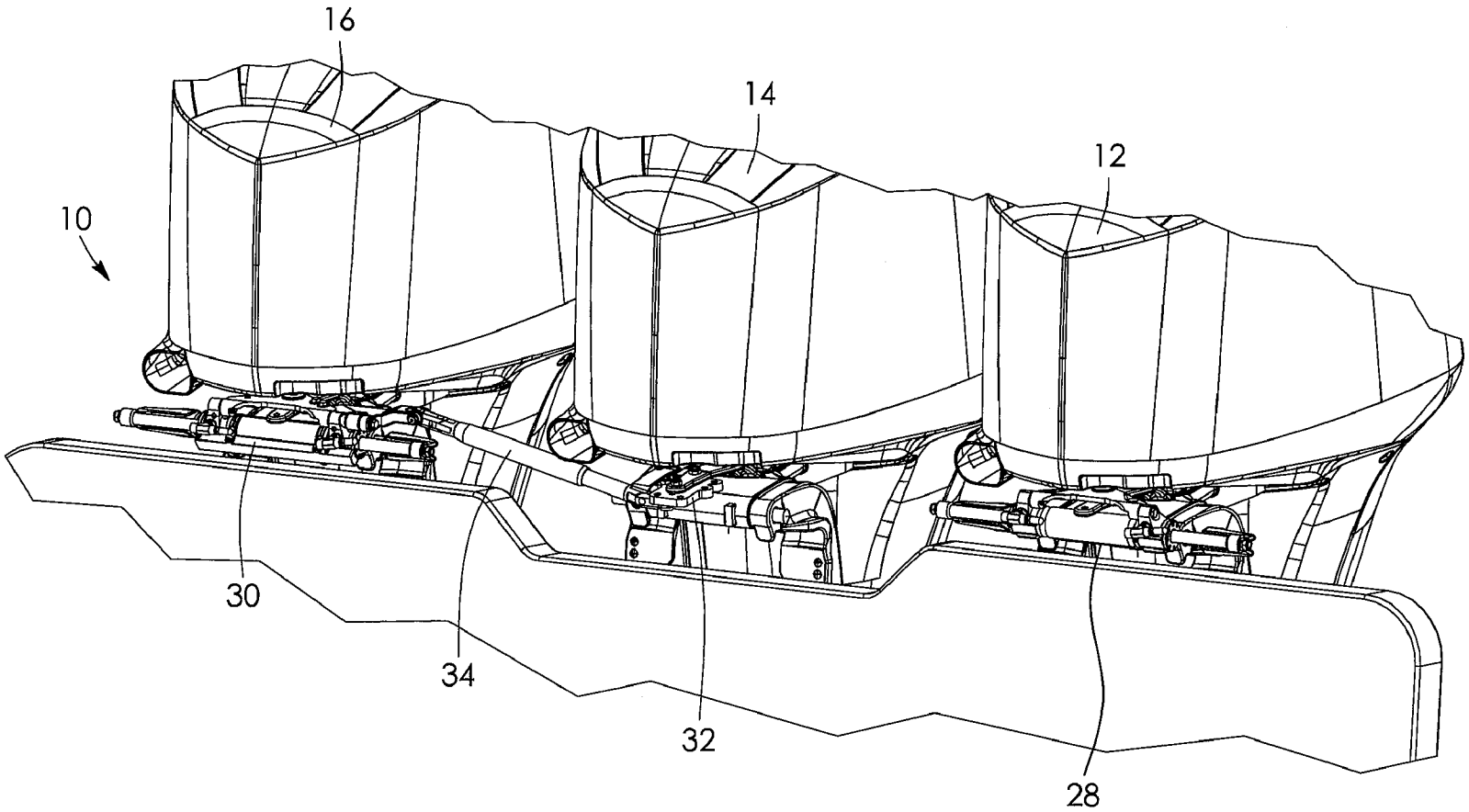
FIG. 3 is a perspective, fragmentary view of the propulsion units and the steering system of FIG. 1 showing a center engine coupled to a starboard engine by a tie bar.

When the marine vessel 10 is steered using the joystick 26, and with reference to FIG. 2, movement of the joystick 26 along an X-axis moves the marine vessel 10 either starboard or port. Movement of the joystick 26 along a Y-axis moves the marine vessel 10 forward or in reverse. Movement of the joystick 26 along a θ-axis rotates the marine vessel 10 starboard or port. The joystick 26 is also moveable along the X-axis, Y-axis, and θ-axis to allow for vector thrusting. The joystick may further be used to provide any combination of partial or full X-axis, Y-axis and θ-axis commands. Movement of the joystick 26 as described above signals a pump control module 25, shown in FIG. 1, which controls the output of hydraulic pumps 27 and 29 which respectively pump hydraulic fluid to hydraulic actuators 28 and 30, shown in FIG. 3, of the port engine 12 and the starboard engine 16 based on the movement of the joystick 26. Steering motion is thereby imparted by the hydraulic actuators 28 and 30 to corresponding ones of the port engine 12 and the starboard engine 16.

However, the center engine 14 is not provided with a corresponding hydraulic actuator. Instead a tiller 32 of the center engine 14 is coupled to the hydraulic actuator 30 of the starboard engine 16 by a tie bar 34. The tie bar 34 accordingly imparts steering motion from the hydraulic actuator 30 of the starboard engine 16 to the tiller 32 of the center engine 14. When the marine vessel 10 is steered using the joystick 26, the center engine 14 is put in neutral and may be trimmed up to reduce drag of the center engine 14 in the water as shown in FIG. 4. Trimming up the center engine 14 reduces the impact of the center engine 14 on marine vessel command performance when the joystick 26 is used to steer the port engine 12 and the starboard engine 16 during, for example, docking or other vector thrusting applications. Alternatively, the center engine 14 may be turned off and tilted out of the water as shown in FIG. 5.

Advantages of coupling the center engine 14 to the starboard engine 16 and putting the center engine 14 in neutral when using the joystick 26 to steer the marine vessel 10 may include:

reducing wear in the steering system which results from wagging of the center engine which occurs in conventional steering systems;

reducing performance issues found in conventional steering systems which result from conventional steering systems having to wait for the center engine to move before being able to steer the marine vessel in accordance with user inputted commands;

reducing the number of components and complexity of the steering system as it is not necessary to provide the center engine with a hydraulic actuator and related components; and allowing for a center engine in situations where it is undesirable to provide the center engine with a hydraulic actuator due to physical constraints.

While the steering system disclosed herein will either put the center engine 14 in neutral or turn off the center engine 14 when the marine vessel 10 is steered using the joystick 26, there are situations when the marine vessel 10 is steered using the joystick 26 in which it may be desirable to leave the center engine 14 in the water to assist marine vessel command performance. For example, it may be desirable to keep the center engine 14 in the water and in reverse if the starboard engine 16 is in reverse and the joystick 26 is being used to steer the marine vessel 10. Due to the center engine 14 being in the water at the same angle as the starboard engine 16, there may be a need for some asymmetry in the engine angle and/or engine thrust in the steering system to steer in one direction versus another.

It will be understood by a person skilled in the art that, in this example, the center engine is coupled to the starboard engine but that in other examples the center engine may be coupled to the port engine.

It will further be understood by a person skilled in the art that many of the details provided above are by way of example only, and are not intended to limit the scope of the invention which is to be determined with reference to the following claims.

What is claimed is:

1. A steering system for a marine vessel comprising:

a first propulsion unit and a hydraulic actuator for imparting steering motion to the first propulsion unit;

a second propulsion unit and a hydraulic actuator for imparting steering motion to the second propulsion unit;

a third propulsion unit and a tie bar coupling a tiller of the third propulsion unit to the hydraulic actuator of the first propulsion unit, the tie bar imparting steering motion from the hydraulic actuator of the first propulsion unit to the tiller of the third propulsion unit; and a joystick for inputting user steering commands to the steering system, wherein movement of the joystick actuates the said hydraulic actuators to impart steering motion to the first propulsion unit and the second propulsion unit.

2. The steering system as claimed in claim 1 wherein the third propulsion unit is in neutral when the joystick is used to input user steering commands.

3. The steering system as claimed in claim 1 wherein the third propulsion unit is trimmed up when the joystick is used to input user steering commands.

4. The steering system as claimed in claim 1 wherein the third propulsion unit is turned off when the joystick is used to input user steering commands.

5. The steering system as claimed in claim 1 further including a pump control module for controlling a supply of hydraulic fluid to the said hydraulic actuators.

6. The steering system as claimed in claim 5 wherein the pump control module controls the supply of hydraulic fluid to the said hydraulic actuators based on the movement of the joystick.

7. The steering system as claimed in claim 1 further including a helm for inputting user steering commands to the steering system.

8. A steering system for a marine vessel comprising:

a first propulsion unit and a hydraulic actuator for imparting steering motion to the first propulsion unit;

a second propulsion unit and a hydraulic actuator for imparting steering motion to the second propulsion unit;

a third propulsion unit and a tie bar coupling a tiller of the third propulsion unit to the hydraulic actuator of the first propulsion unit, the tie bar imparting steering motion from the hydraulic actuator of the first propulsion unit to the tiller of the third propulsion unit;

a joystick for inputting user steering commands to the steering system, wherein movement of the joystick actuates the said hydraulic actuators to impart steering motion to the first propulsion unit and the second propulsion unit; and a pump control module for controlling a supply of hydraulic fluid to the said hydraulic actuators based on the movement of the joystick.

9. The steering system as claimed in claim 8 wherein the third propulsion unit is in neutral when the joystick is used to input user steering commands.

10. The steering system as claimed in claim 8 wherein the third propulsion unit is trimmed up when the joystick is used to input user steering commands.

11. The steering system as claimed in claim 8 wherein the third propulsion unit is turned off when the joystick is used to input user steering commands.

12. The steering system as claimed in claim 8 further including a helm for inputting user steering commands to the steering system.

* * * * *